US006966305B2

(12) United States Patent
Aubrée et al.

(10) Patent No.: US 6,966,305 B2
(45) Date of Patent: Nov. 22, 2005

(54) FUEL DELIVERY ASSEMBLY FOR VEHICLES

(75) Inventors: Laurent Aubrée, La ville aux bois lès Pontavert (FR); Remi Aubrée, Falaise (FR)

(73) Assignee: Walbro Engine Management, L.L.C., Tucson, AZ (US)

( * ) Notice: Subject to any disclaimer, the term of this patent is extended or adjusted under 35 U.S.C. 154(b) by 34 days.

(21) Appl. No.: 10/664,116

(22) Filed: Sep. 17, 2003

(65) Prior Publication Data

US 2004/0060547 A1 Apr. 1, 2004

(51) Int. Cl.[7] ..... F02M 37/04
(52) U.S. Cl. ..... 123/509; 123/497; 123/510
(58) Field of Search ..... 123/497, 509, 123/468, 469, 506, 510, 514

(56) References Cited

U.S. PATENT DOCUMENTS

| | | | | |
|---|---|---|---|---|
| 4,569,637 | A | | 2/1986 | Tuckey |
| 4,747,388 | A | | 5/1988 | Tuckey |
| 4,860,714 | A | | 8/1989 | Bucci |
| 4,945,884 | A | * | 8/1990 | Coha et al. ..... 123/509 |
| 4,961,693 | A | | 10/1990 | Hoover et al. |
| 4,964,787 | A | | 10/1990 | Hoover |
| 5,038,741 | A | | 8/1991 | Tuckey |
| 5,040,516 | A | * | 8/1991 | Haraguchi ..... 123/509 |
| 5,427,074 | A | | 6/1995 | Tuckey |
| 5,647,329 | A | * | 7/1997 | Bucci et al. ..... 123/509 |
| 6,012,904 | A | | 1/2000 | Tuckey |
| 6,155,238 | A | * | 12/2000 | Briggs et al. ..... 123/509 |
| 6,206,037 | B1 | * | 3/2001 | Murakoshi et al. .... 137/565.34 |
| 6,213,100 | B1 | | 4/2001 | Johansen |
| 6,302,144 | B1 | | 10/2001 | Graham et al. |
| 6,328,063 | B1 | * | 12/2001 | Tistchenko ..... 137/565.22 |
| 6,378,504 | B1 | * | 4/2002 | Horiuchi et al. ..... 123/509 |

* cited by examiner

*Primary Examiner*—Weilun Lo
(74) *Attorney, Agent, or Firm*—Reising, Ethington, Barnes, Kisselle, P.C.

(57) ABSTRACT

The present invention relates to a fuel delivery assembly for vehicle fuel tanks, that includes: a first assembly forming a mount adapted to be fixed onto a wall of a fuel tank and which carries at least one accessory, a second assembly including an electric motor fuel pump, and a third assembly comprising at least two interchangeable linking members respectively fixed on the first assembly and on the second assembly, to provide support to the second assembly from the first assembly.

34 Claims, 12 Drawing Sheets

183
100
127
129
126
128
125
150
151
133
132
131
152
160
140
145
143
138
144
142
148
139
146
137
141
141'
170
320
300
310
320
313
323
257
176
200
258
177
230

FUEL DELIVERY ASSEMBLY FOR VEHICLES

FIELD OF THE INVENTION

The present invention relates generally to fuel delivery systems for vehicles and more particularly to a modular fuel delivery assembly.

BACKGROUND OF THE INVENTION

Numerous fuel delivery devices and systems have already been proposed. Some fuel delivery devices are disposed in a vehicle fuel tank in modular form. These modules are designed specifically for a given fuel tank configuration or application and different fuel tank configurations require different fuel delivery module designs to account for, among other things, different fuel tank depth and available mounting locations for the modules. Some fuel delivery devices include an associated fuel level sensor.

SUMMARY OF THE INVENTION

A fuel delivery device has a first assembly forming a mount adapted to be fixed onto a wall of a fuel tank and which carries at least one accessory, a second assembly includes an electric motor fuel pump, and a third assembly includes at least two interchangeable linking members respectively fixed on the first and second assemblies, to provide support to the second assembly, from the first assembly. The use of the third assembly comprising at least two interchangeable linking members interposed between the first assembly forming a mount and the second assembly including an electric motor fuel pump enables standardization of the first and second assemblies and simple adaptation of the fuel delivery assembly to different environments. This is because, by virtue of the basic structure provided in the context of the present invention, the delivery assembly can easily be adapted, with a standard first assembly forming a mount and a standard second assembly including an electric motor fuel pump, to any desired fuel level sensor configuration, and in particular any fuel tank configuration and geometry, by simple change and selection of appropriate linking members of the third assembly.

According to other advantageous but non-limiting features of the present invention: at least one linking member of the third assembly is of a tubular type and forms a conduit for the passage of fuel; the first assembly, the third assembly and the second assembly are arranged in series; the first assembly preferably carries a fuel filter, a pressure regulator, and a fuel level sensing device. Preferably, the first assembly has a filter casing formed from two welded parts, forms a mount having integral additional conduits ensuring the passage of fuel, has a fuel filter fixed by simple clamping, a housing for receiving a regulator and defines coaxial inlet and outlet fuel conduits for the regulator. Preferably, the second assembly including an electric motor fuel pump is equipped with a filter provided with an end portion adapted to extend the inlet of the pump to limit the risk of the fuel pump becoming unprimed. Of course, a fuel delivery device may achieve fewer or additional objects, features and advantages while still falling within the spirit and scope of the invention as set forth in the appended claims.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
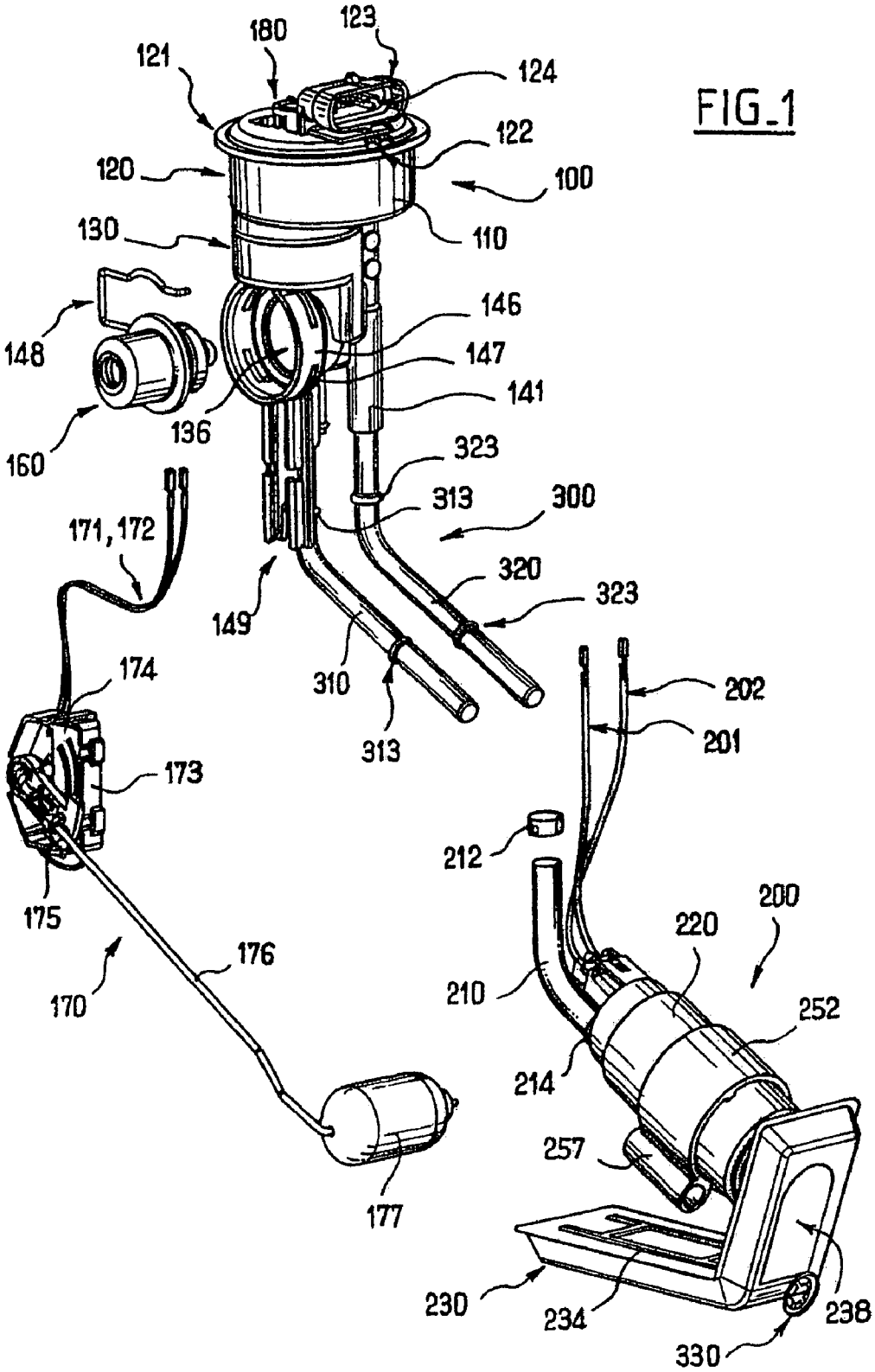
FIG. 1 is an exploded perspective view of a presently preferred embodiment of a fuel delivery assembly.

Referring in more detail to the drawings, FIG. 1 illustrates one presently preferred embodiment of a modular fuel delivery assembly or module that includes three assemblies: a first assembly 100 forming a mount, a second assembly 200 including an electric motor fuel pump, and a third assembly 300 linking the first two assemblies 100 and 200 together.

The first assembly 100 forming a mount is adapted to be fixed on a wall of the fuel tank, and preferably carries at least one accessory, such as a fuel level sensor 170. The first assembly 100 forming a mount principally comprises a body 110 preferably of plastic construction, and more preferably of POM (polyoxymethylene).

Figure 3:
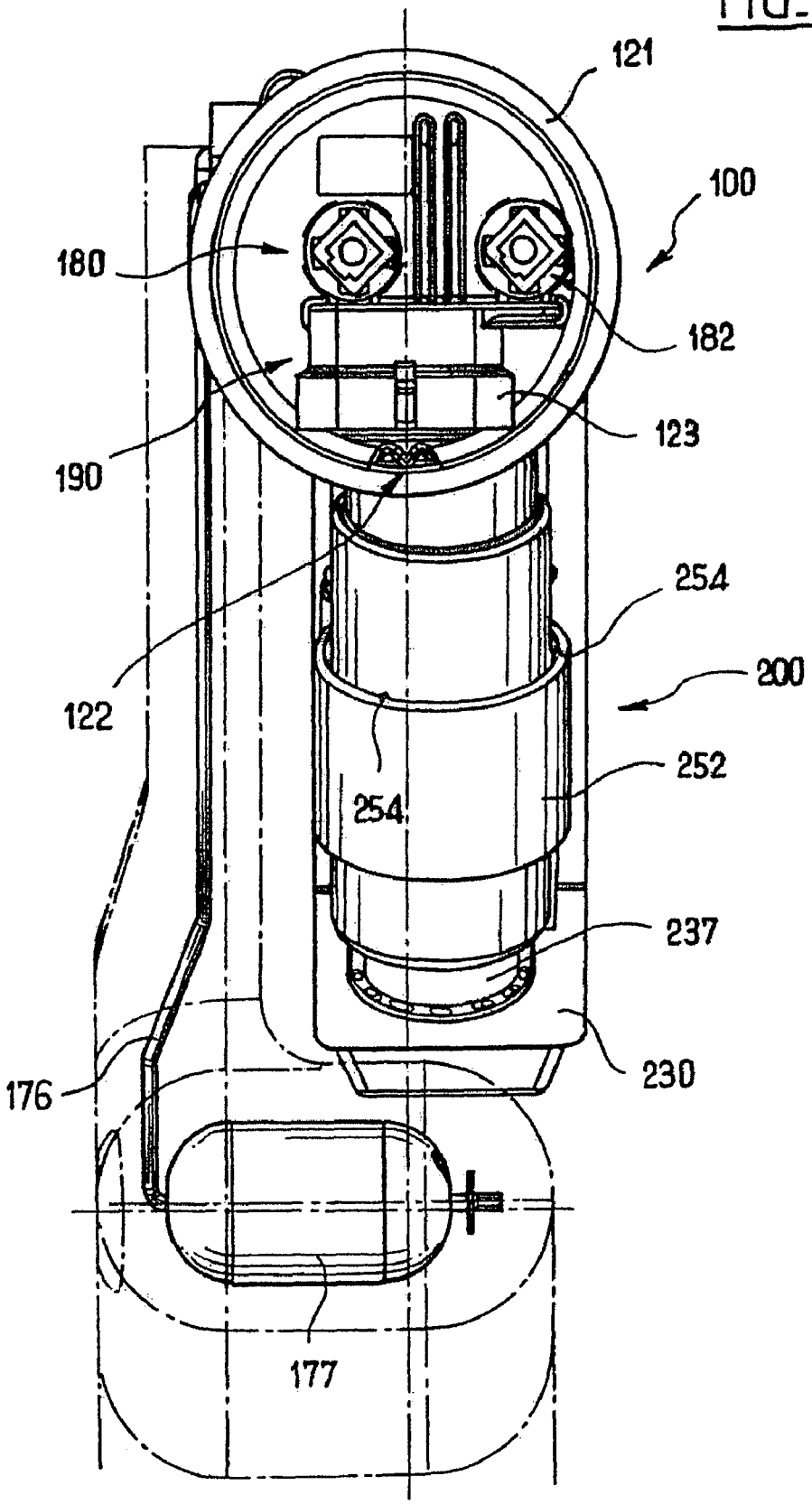
FIG. 3 is a plan view of the fuel delivery assembly.
Figure 4:
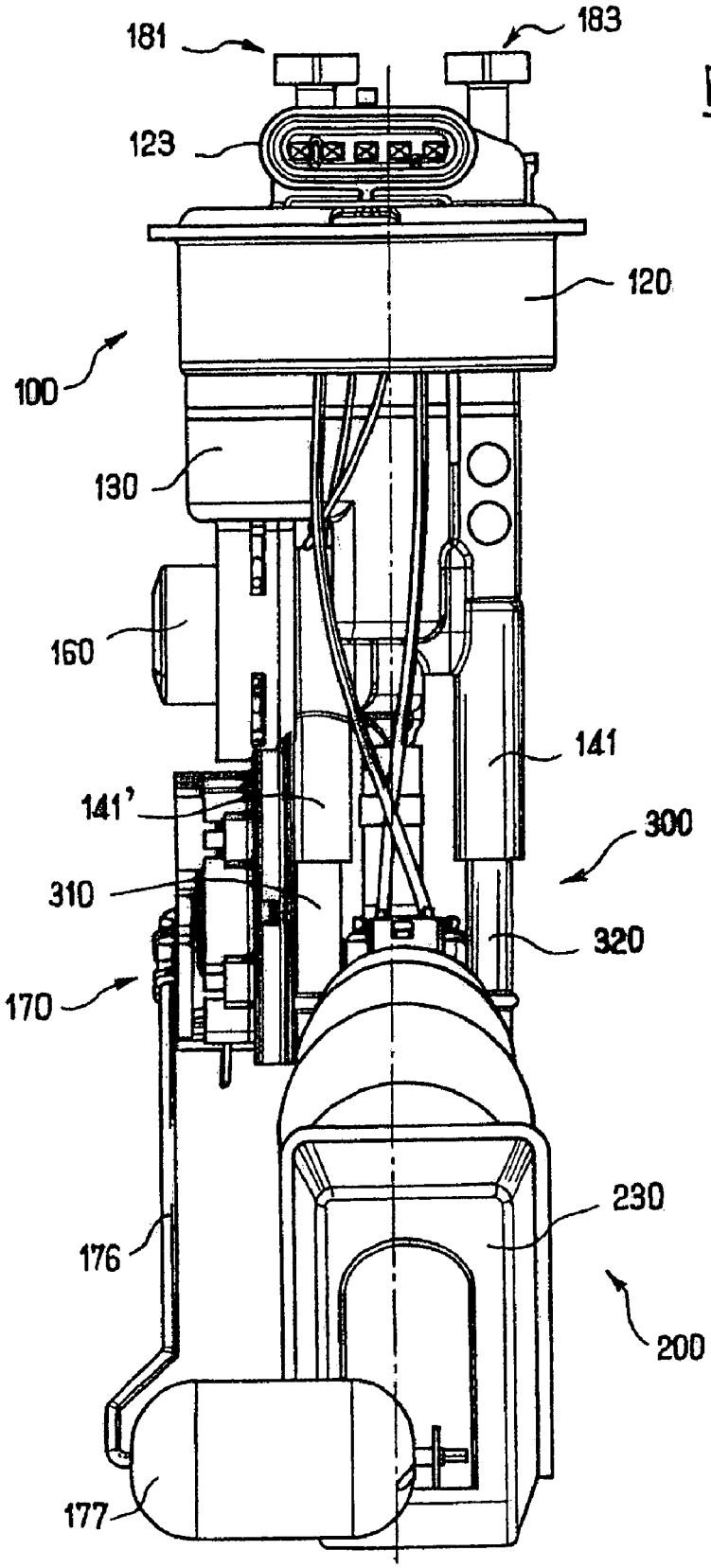
FIG. 4 is an end view of the fuel delivery assembly.

The body 110 of the first assembly 100 preferably carries a filter 150, a regulator 160, a fuel level sensor 170, fluid connector pipes 180, 182, and an electrical connector 190 adapted to provide an electrical connection with the fuel level sensor 170 and with the fuel pump assembly 200. The body 110 of the first assembly 100 is comprised at least in part of two corresponding shells 120 and 130 of plastic construction. The upper shell 120 includes a radially outwardly extending flange 121 preferably in the general form of a circular disk. Moreover, the flange 121 is preferably provided with indicia such as an impression 122 adapted to facilitate orienting the device, about a vertical axis, in the fuel tank. Advantageously, this impression 122 is provided on the periphery of the flange 121, as best shown in FIGS. 1 and 3.

The flange 121 carries the two connector pipes 180, 182 on its upper surface. One of these pipes 180 is in the supply line from the fuel pump to the engine. The other pipe 182 is in the return line and receives unused fuel back from the engine into the fuel tank. These pipes 180, 182 communicate with conduits which will be described in more detail below.

In the accompanying drawings, connectors 181, 183 have been illustrated respectively associated with each of these of these two pipes 180, 182 to provide the connection of the pipes with any appropriate external conduit. The particular connectors 181, 183 illustrated on the accompanying drawings are conventionally known as male "John Guest" connectors. They are well known to the person skilled in the art and will not be described in more detail below.

In the preferred embodiment, the flange 121 also carries a connector body 123 on its upper surface. The upper shell 120 and in particular the flange 121 and the connector body 123 are preferably molded onto electrically conducting contacts 124 (FIG. 1) accessible both on the upper surface of the flange 121 at the connector body 123, and on the lower surface of the flange 121 to provide electrical connection to the fuel level sender by way of connecting wires 171, 172, as well as with the fuel pump assembly 200 by way of connecting wires 201, 202.

On its lower surface the flange 121 includes two cylindrical cups that are preferably not concentric: an outer cup 125 and an inner cup 126. On its lower surface the flange 121 preferably also carries or includes a conduit 127 arranged in the housing defined between the two cups 125, 126. The conduit 127 extends perpendicularly to the medial plane of the flange 121. The conduit 127 connects with the pipe 182 and also connects with the base of the upper shell 120 to cooperate with a similar conduit provided on the lower shell 130 as will be described below. The conduit 127 thus receives and guides fuel returned from the engine or other location downstream of the apparatus (relative to the fuel pump).

The inner cylindrical cup 126 in combination with a similar cup 131 provided on the lower shell 130, defines a chamber 128 adapted to receive a filter 150. On its lower surface, the flange 121 carries or includes an outlet conduit 129 which is connected with the aforementioned pipe 180 and communicates with the center of the chamber 128. The outlet conduit 129 thus serves to direct filtered fuel to the engine.

Figure 5:
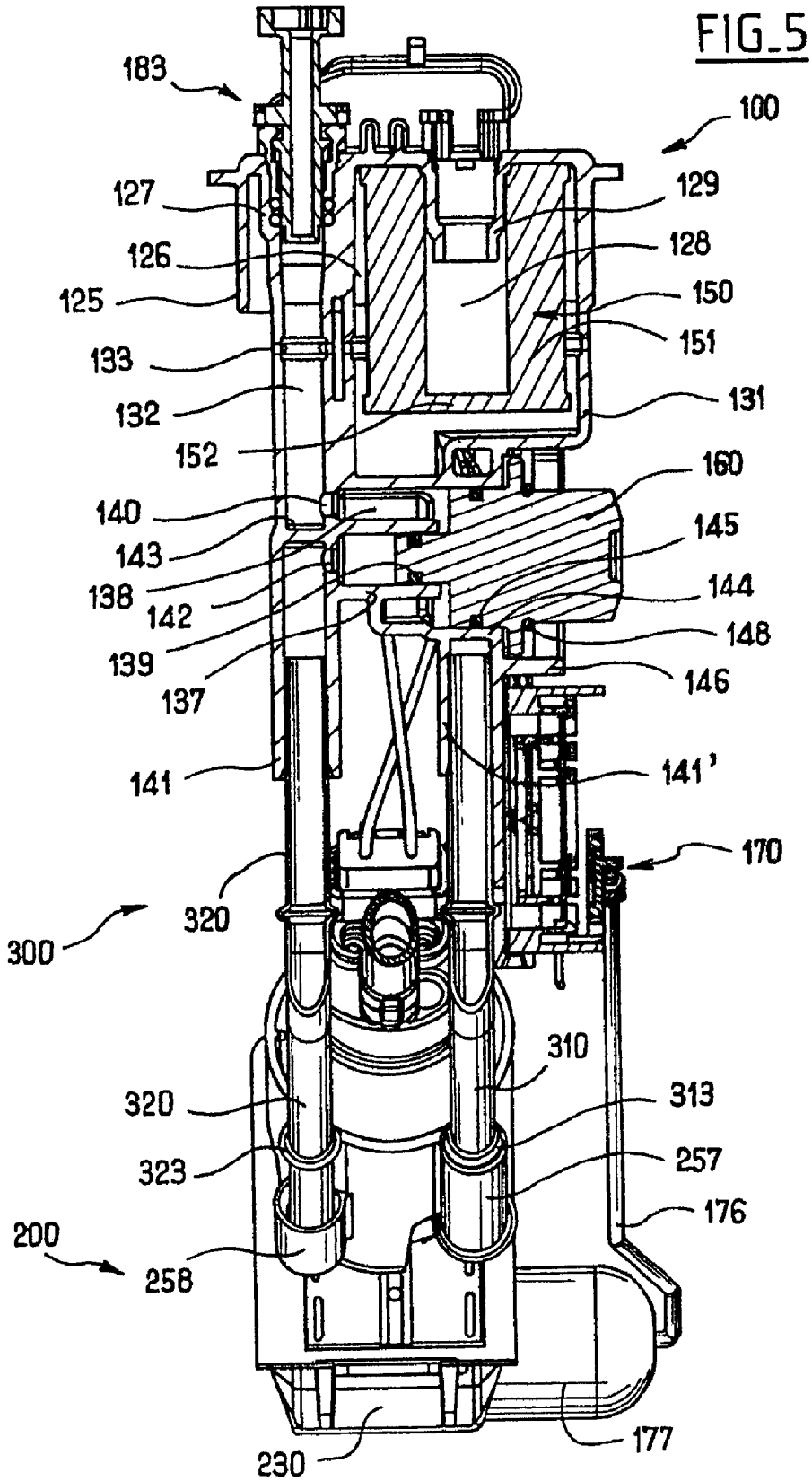
FIG. 5 is an end view partially in section of the fuel delivery assembly.

The filter 150 is preferably of generally annular geometry. Still more particularly, the filter 150 is preferably U-shaped in cross-section as best shown in FIG. 5. It thus comprises an annular filtering structure 151 closed at its base by a fluid-tight web 152. At its apex, the filtering structure 151 has an opening preferably sized to closely receive the outlet conduit 129 and provide a fluid-tight seal between them. Accordingly, fuel injected into the chamber 128, on the outer periphery of the filtering structure 151, as will be described in more detail below, passes radially inwards through the filtering structure 151, and, once filtered, leaves the chamber 128, via the outlet conduit 129 and pipe 180, toward the engine. The filter 150 is thus held in the chamber 128 defined by the two shells 120, 130, preferably by simply clamping or being press-fit onto the outlet conduit 129.

The lower shell 130 further defines a blind conduit 132 adapted to extend the conduit 127 to direct the returned fuel not used by the engine to the regulator 160. The two shells 120 and 130 are fixed together in the plane 133 where they are joined by a fluid-tight weld. This fluid-tight weld is adapted to ensure fluid connection between the conduits 127 and 132, without leakage to the exterior, and also to ensure fluid-tightness between the cup 126 which is downwardly concave and the cup 131 which is upwardly concave, it being noted, however, that the filter chamber 128 further comprises a fuel outlet defined by the outlet conduit 129, and pipe 180 and a fuel inlet which will now be described.

Figure 6:
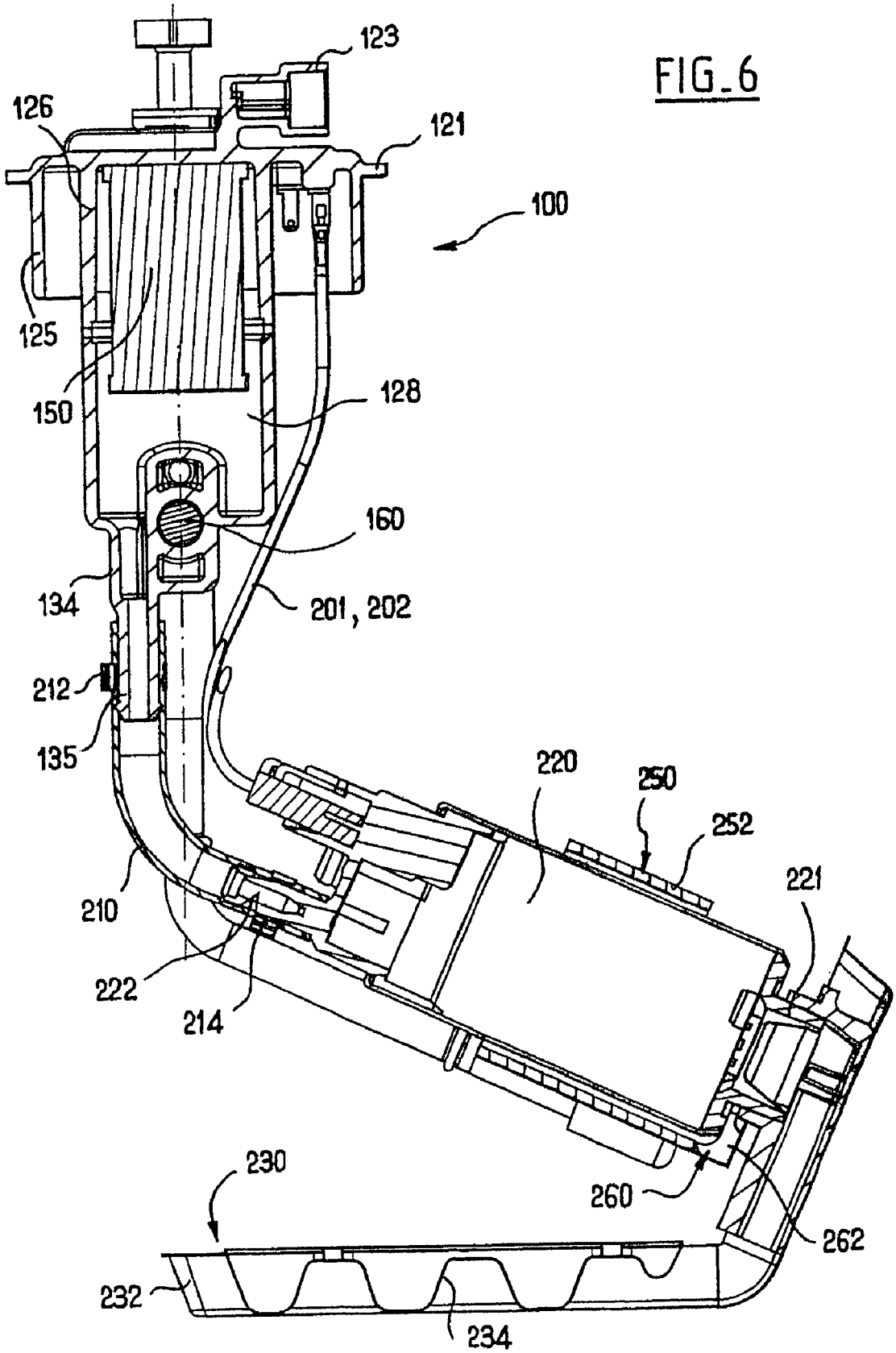
FIG. 6 is a section view of the fuel delivery assembly.
Figure 7:
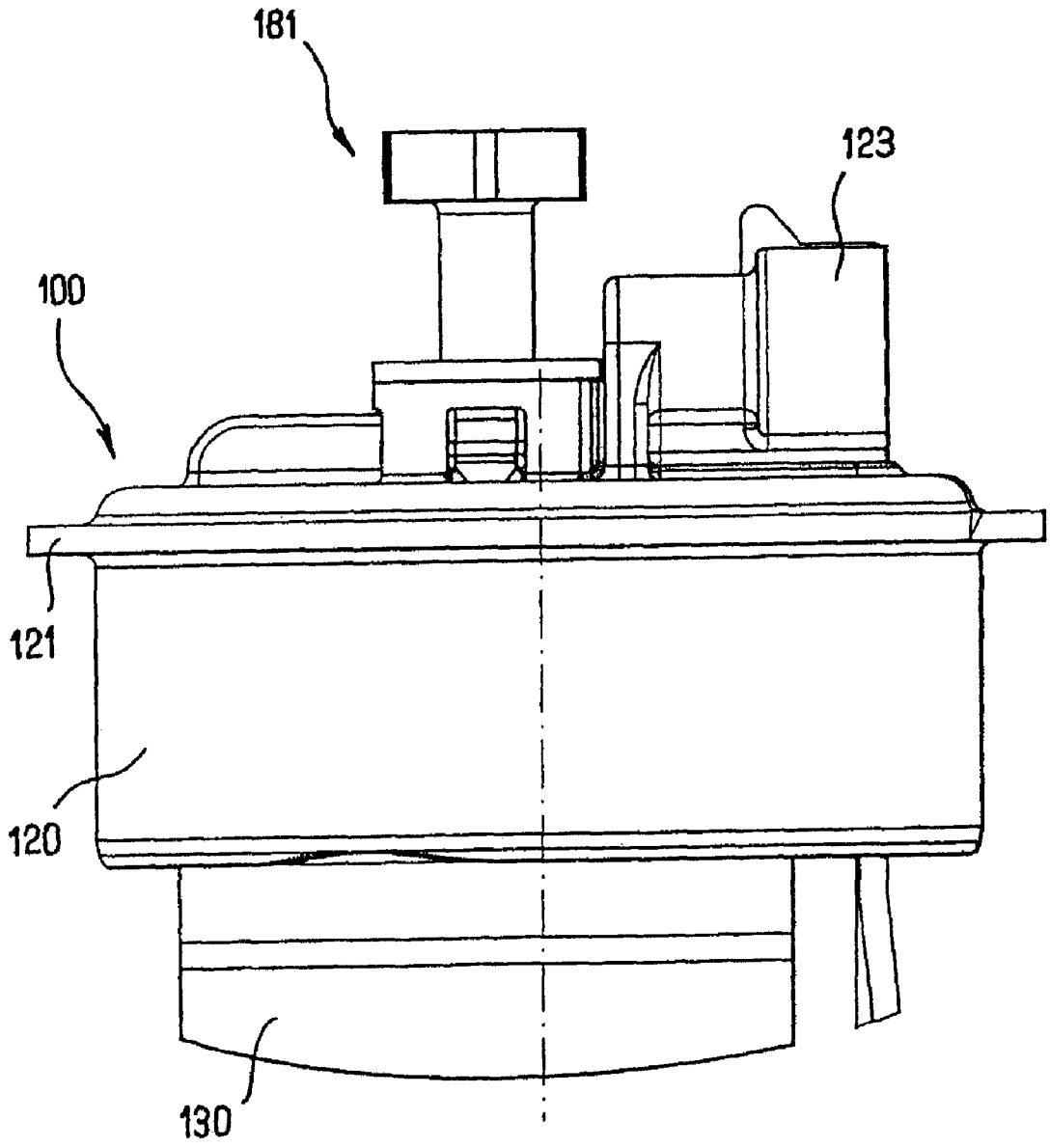
FIG. 7 is an exterior side view of a first assembly of the fuel delivery assembly.
Figure 8:
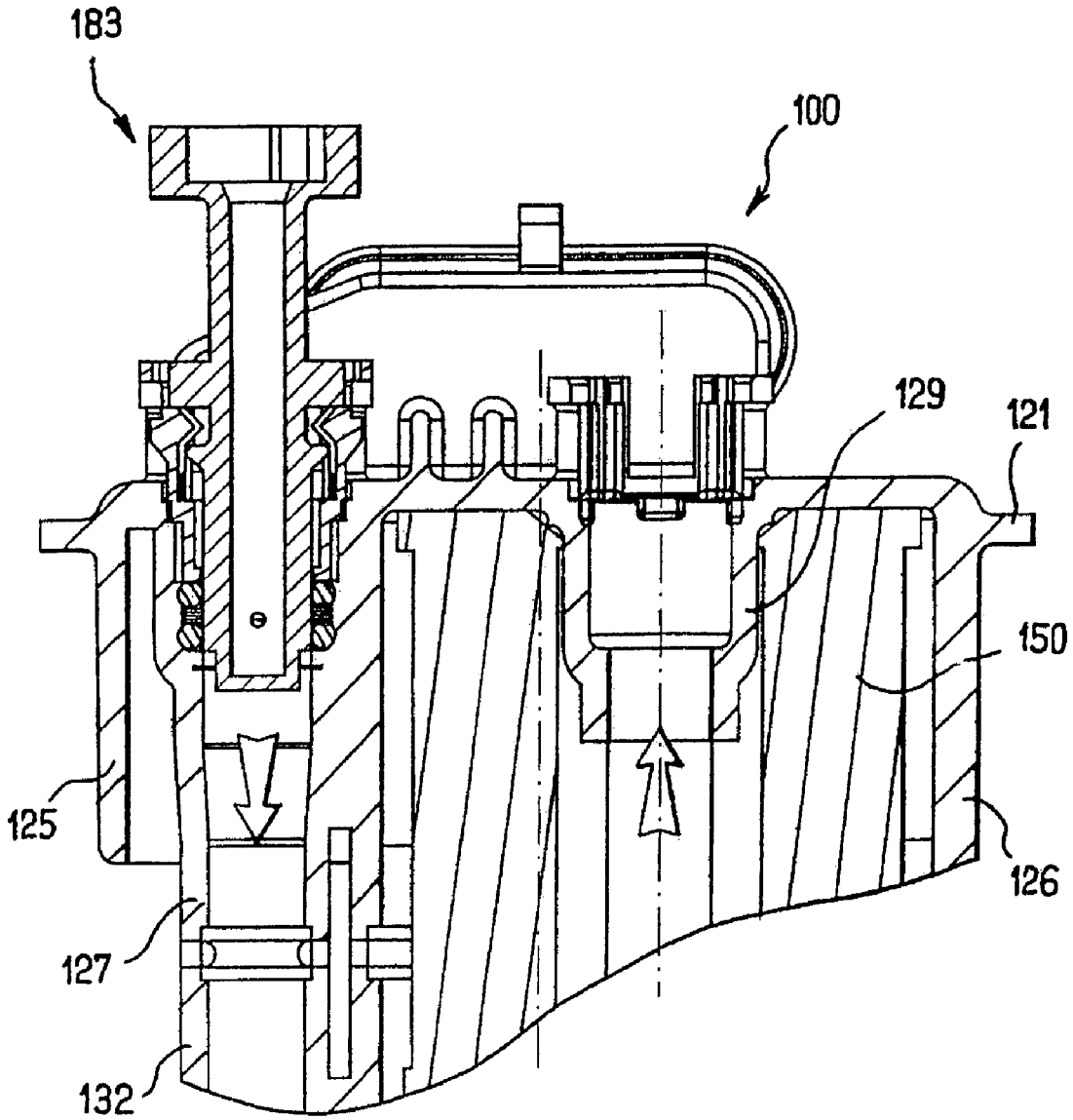
FIG. 8 is a fragmentary sectional view of the first assembly of FIG. 7.
Figure 10:
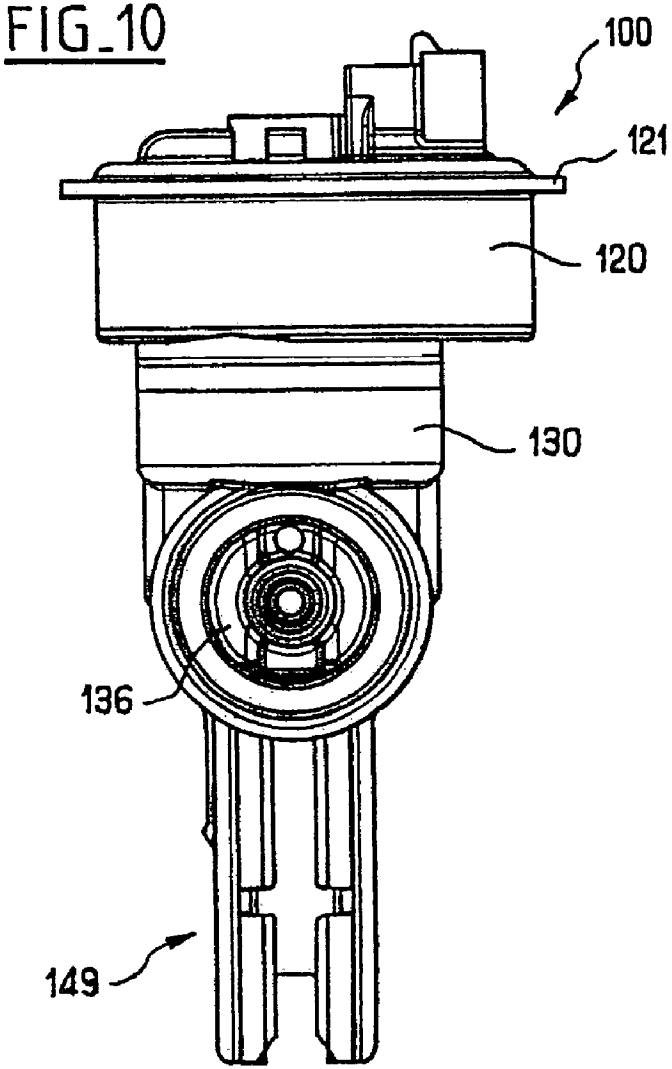
FIG. 10 is an elevational view of the first assembly illustrating a housing for a pressure regulator.
Figure 9:
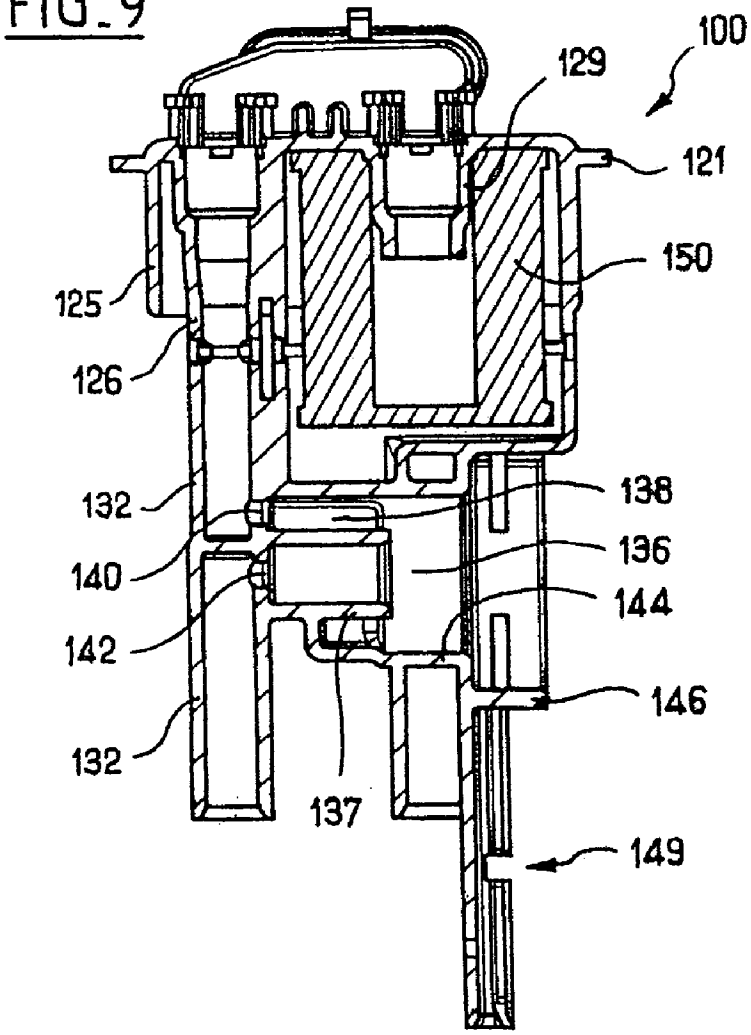
FIG. 9 is a sectional view of the first assembly.

As best shown in FIG. 6, an inlet conduit 134 passes through the base of the cup 131 and communicates with the interior of the chamber 128. This inlet conduit 134 comprises an end portion or nipple 135 projecting downwardly and adapted to receive a conduit or the like for communication with the outlet of the fuel pump, for example in the form of a corrugated flexible hose 210. Fluid-tightness between the flexible hose 210 and the nipple 135, and with the outlet of the fuel pump is preferably ensured by means of hose clamps 212, 214.

As best shown in FIG. 1, the base of the cup 130 further comprises a housing 136 adapted to receive the pressure regulator 160. In a manner known per se, the function of such a pressure regulator 160 is to limit or control the pressure of the fuel supplied to the engine. In this embodiment, the regulator is provided in the return line for fuel not consumed by and returned from the engine. Preferably, the regulator 160 is arranged in a casing 161 (FIG. 16) carried by the fuel delivery assembly in the housing 136.

Figure 16:
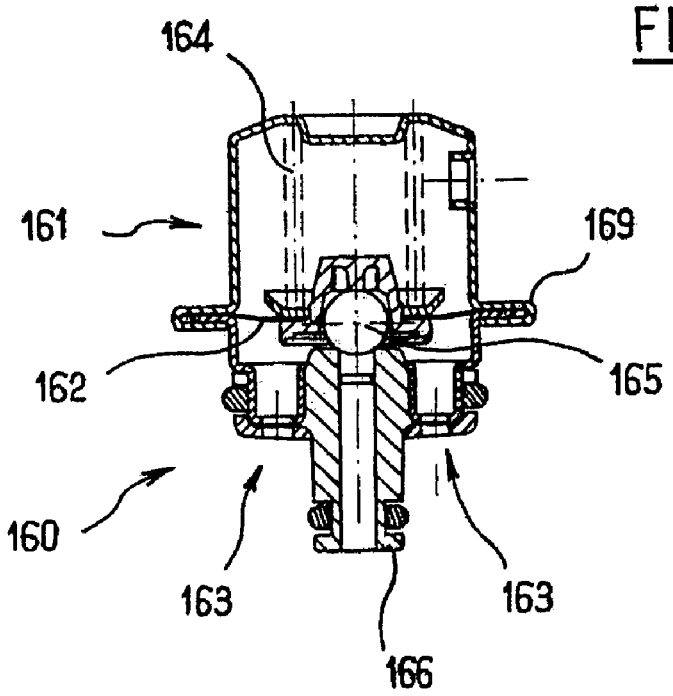
FIG. 16 is a sectional view of a pressure regulator.

Preferably, the pressure regulator 160 is constructed generally as shown diagrammatically in FIG. 16. As shown in FIG. 16, the pressure regulator 160 essentially comprises a diaphragm 162 subjected on one side to the pressure of fuel entering the casing 161 via the inlet orifice 163 formed in the casing 161. The membrane 162 is urged from the other side by a biasing member such as a spring 164. The membrane 162 includes a valve head 165 facing and selectively closing an outlet pipe 166.

At rest, when the pressure of the fuel exerted on the diaphragm 162 is less than the bias force exerted on the diaphragm 162 by the spring 164, the diaphragm 162 is urged by the spring 164 towards the outlet pipe 166 such that the valve head 165 closes the outlet pipe 166. With the valve head 165 in this position, fuel cannot then flow through the regulator 160 and no fuel is then directed back from the engine to the fuel tank.

When the pressure of the fuel exerted on the diaphragm 162 becomes greater than the force exerted by the spring 164, the diaphragm 162 is displaced by the fuel away from the outlet pipe 166, through compression of the spring 164. The valve head 165 is then moved away from the outlet pipe 166, and excess fuel at the engine is then returned to the fuel tank via the regulator 160.

The housing 136 is formed from a cylindrical housing centered on an axis perpendicular to the vertical axis of the mount, in other words, perpendicular to the axis of the filter chamber 128. As shown in FIG. 5, the far end of the housing 136 defines a central cylindrical barrel 137 surrounded by an annular chamber 138. The central cylindrical barrel 137 is adapted to receive, and seal with, such as by way of an O-ring 139, the outlet pipe 166 of the regulator. The annular chamber 138 communicates with the inlet orifices 163 of the regulator 160.

The lower shell 130 has a passage 140 communicating the conduit 132 receiving the returned fuel, previously described, with the annular chamber 138. The lower shell 130 furthermore has a second blind section of pipe 141 preferably aligned with the conduit 132. Pipe 141 communicates at its upper portion, by an orifice 142 with the internal volume of the cylindrical barrel 137. The section of pipe 141 furthermore communicates with the lower portion of the lower shell 130, and is adapted to receive one of the linking members 320.

The lower shell 130 thus defines a set of pipes comprising two coaxial sections 132, 141 separated by an intermediate fluid-tight membrane or wall 143 (see FIG. 5). The upper conduit 132 receives the fuel coming back from the engine and directs it to the inlet 163 of the regulator. The lower conduit or pipe 141 receives the fuel from the outlet 166 of the regulator, when the pressure of the fuel exceeds the biasing force of the spring 164. Conduit 132 and pipe 141 preferably extend parallel to the pipes 127 and 129, i.e. parallel to the axis of the filter chamber 128.

The housing 136 defines a circular chamber 144 corresponding to the outer cross-section of the casing 161 of the regulator. Fluid-tightness is achieved between the outer periphery of the casing 161 and that chamber 144 by means of an O-ring seal 145. Around the periphery of the opening of the chamber 144, the housing 136 furthermore defines a collar 146 corresponding with an outwardly directed flange 169 (FIG. 16) defined on the regulator 160. The flange 169 clamps and holds the periphery of the membrane 162. The collar 146 is provided with apertures 147 adapted to receive a metal pin 148 for fixing the regulator 160 in the housing 136. For this purpose, the pin 148 engages with the apertures 147 of the collar 146, and serves as a bearing for the outwardly directed flange 169 of the regulator.

As shown in FIG. 1, the lower shell 130 preferably further defines a slide rail 149 adapted to receive a housing 173 of the fuel level sensor 170. This is held on the slide rail 149 by any appropriate means, for example by snap-fitting. The slide rail 149 may be the subject of numerous variant embodiments. It will thus not be described in detail.

In the preferred embodiment, the assembly comprising lower shell 130, i.e. the cup 131, the conduit members 132, 141, the housing 136 having the central barrel 137 and the annular chamber 138, the chamber 144 and the collar 146, as well as the slide rail 149 are integrally formed as a single piece of plastic construction.

Figure 2:
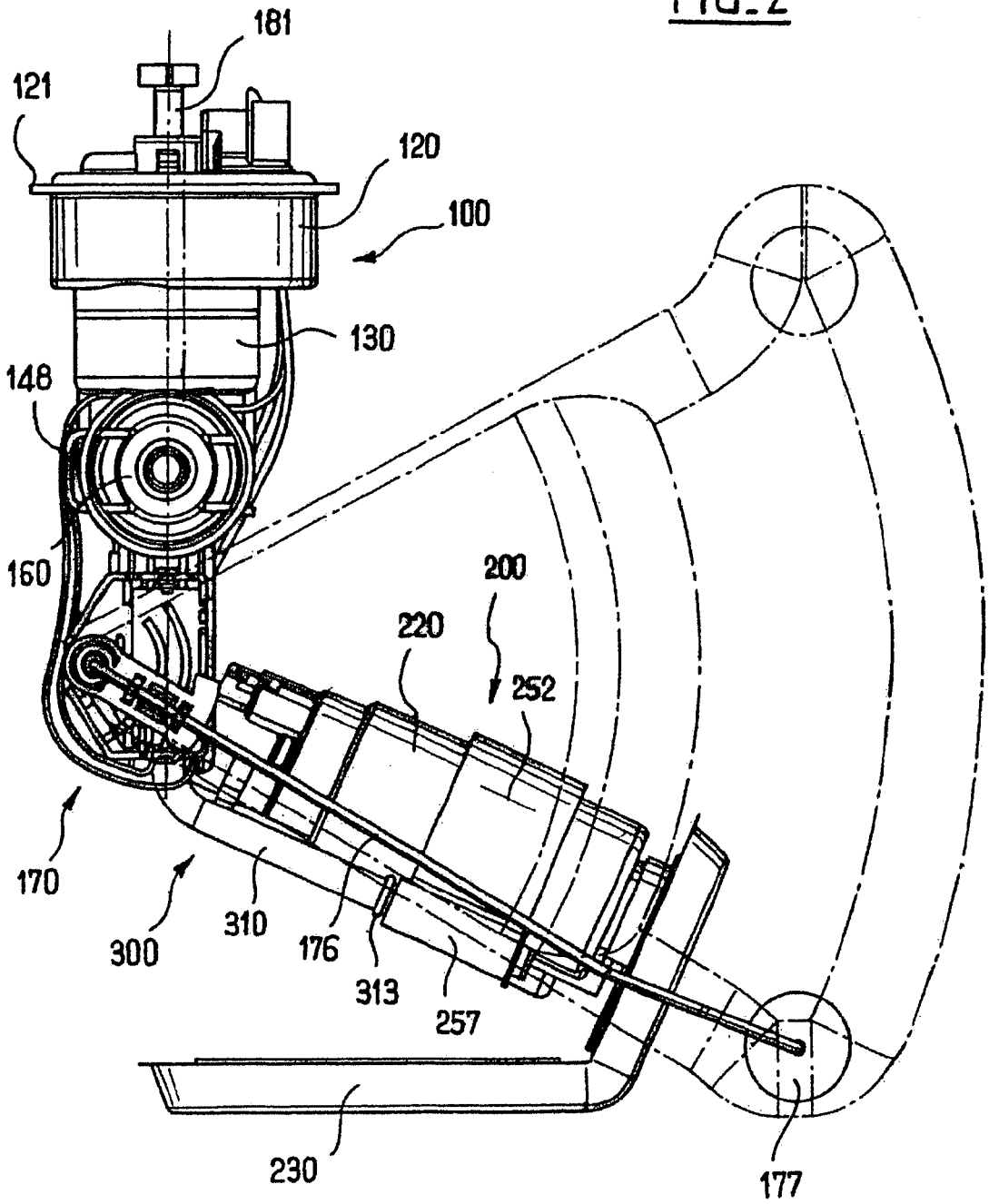
FIG. 2 is a side view of the fuel delivery assembly of FIG. 1 illustrating the angular travel of an associated fuel level sensor.

The fuel level sensor 170 preferably comprises a standard mechanism known per se. It will thus not be described in detail. It is nevertheless to be recalled that the fuel level sensor 170 preferably comprises a casing 173 which houses an electrically insulating support 174 provided with tracks of electrical resistor material on which moves a follower connected to a movable element 175 connected by an arm 176 to a float 177 adapted to follow the level of fuel in the tank. The connection between the electrical tracks of the fuel level sensor and the contacts 124 of the connector 123 is provided by appropriate wires 171, 172. The travel of the float 177 during gauging is illustrated by lines in FIG. 2.

The second assembly 200 principally comprises an electric motor fuel pump 220 that may be conventional and of substantially any type, including without limitation, turbine or positive displacement type fuel pumps. As shown in FIG. 6, the fuel pump 220 is advantageously provided on its outlet with a non-return valve or check valve 222 so fuel may be discharged from the fuel pump, but fuel is prevented from re-entering the fuel pump 220 through its outlet. The fuel pump 220 is furthermore provided with a filter 230 on its inlet. The filter 230 comprises an envelope 232 formed of fabric having a specific mesh size and advantageously of a synthetic material.

Figure 11:
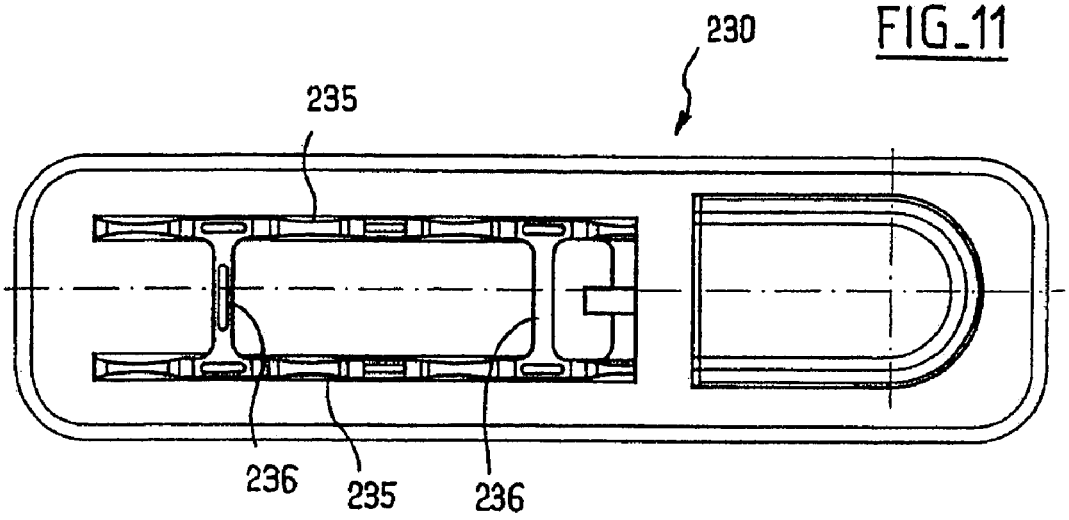
FIG. 11 is a partial view of a filter arranged on the inlet of a fuel pump.

Preferably, the filter 230 is provided, within the filter envelope 232, with a brace 234 serving as a spacer, adapted to keep apart the lower and upper walls of the filter. The spacer 234 may be the subject of numerous variant embodiments. According to a specific embodiment illustrated in particular on FIG. 11, the brace 234 has the general form of a ladder composed of two sides 235 undulated with a sinusoidal form, connected together by cross-pieces 236. The sides 235 extend in the direction of the length of the filter 230. The undulations of the sides 235 are generally situated in planes perpendicular to the upper and lower faces of the filter envelope 232. In other words, the crests of the undulations are respectively adjacent to the upper and lower faces of the filter envelope 232. Naturally the brace 234 may be formed of any other suitable shape.

Figure 12:
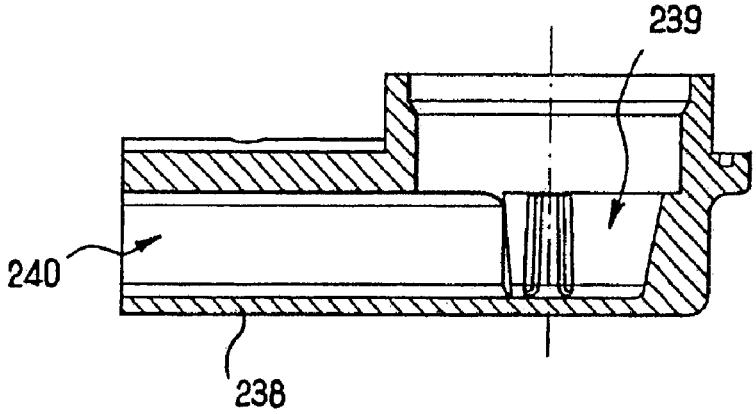
FIG. 12 is a sectional view of an end portion integral with the filter.
Figure 13:
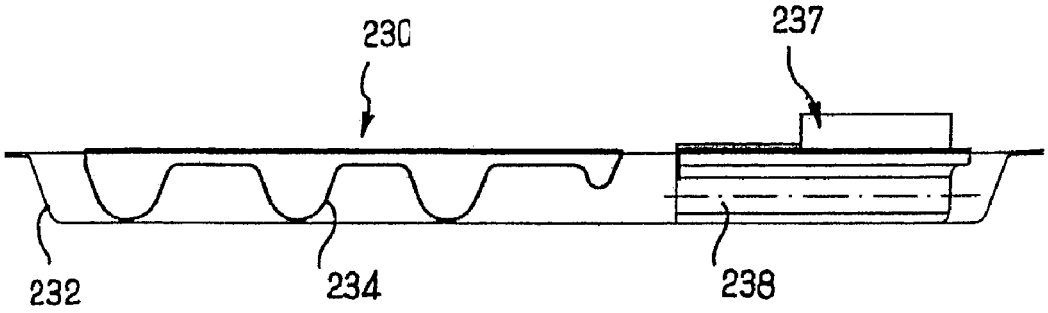
FIG. 13 is a diagrammatic side view of the filter.

As best shown in FIG. 6, the outlet of the filter 230 is adapted to be fixed in fluid-tight manner on the inlet 221 of the pump 220. For this purpose, the outlet of the filter 230 preferably comprises an end portion 237 (FIGS. 3 and 13) corresponding to the inlet 221 of the pump 220. Still more particularly, this end portion 237 is preferably extended, within the filter 230, by a conduit 238 (FIGS. 12 and 13) of plastic material adapted to extend the inlet 221 of the pump and lower the point of intake of the pump 220 through the filter 230 as much as possible in order to reduce the likelihood that the fuel pump will become unprimed. The end portion 237 has an inner section corresponding to the inlet 221 of the fuel pump 220. Thus the filter 230 is adapted to be fixed by simple clamping on the inlet 221 of the fuel pump 220. The brace 234 and the end portion 237 are preferably of plastics material, advantageously POM (polyoxymethylene).

The conduit 238 preferably has the general form of an L. It thus comprises two orthogonal sections: one 239 coaxially extending the end portion 237, the other 240 being perpendicular thereto. The two sections 239, 240 communicate with each other. Section 240 communicates with the internal space of the filter envelope 232.

Preferably, the end portion 237 is not joined to the brace 234. Thus, as can be seen by comparing FIGS. 6 and 13, the filter 230 may be bent by deformation of the intermediate zone situated between the end portion 237 and the brace 234 to adapt the geometry of the filter 230 to the environment, and leave the lower face of the filter 230 resting against the bottom of the tank. This facilitates providing an intake point for the fuel pump 220 through the filter 230 as low as possible.

Preferably the second assembly 200 further comprises a support 250 for the electric pump 220. The support 250 preferably comprises a cylindrical body or annulus 252 of which the internal section, having an inner diameter slightly greater than the outer envelope of the electric pump 220, is provided with a plurality of internal longitudinal ribs 254 equally spaced around the axis of the annulus 252. Thus, three longitudinal ribs 254 are preferably provided equally spaced on the inner surface of the annulus 252. Each of the ribs 254 itself is preferably of semi-cylindrical cross-section. Furthermore, the height which the ribs 254 project from the inner surface of the annulus 252 increases towards the base of the annulus 252 such that, when it is put in place in the annulus 252, an interference fit is provided between the fuel pump 220 and the annulus 252 where the fuel pump 220 is fixed by being wedged by or press-fit in the aforementioned ribs 254. The annulus 252 is further provided, on its outer surface, with two tubular portions 257, 258 adapted respectively to receive the lower ends of the linking members 310 and 320.

The annulus 252 forming a housing for receiving the electric pump 220 preferably further includes, at its base, structure or structures adapted to fix the electric pump 220.

Thus, an arm 260 is preferably provided having the form of a section of a cylinder extending from a portion of the envelope of the annulus 252. This arm 260 is itself provided at its lower end with a finger 262 radially directed towards the axis of the annulus 252. As best shown in FIG. 6, this finger 262, which extends partway across the outline of the opening of the annulus 252 at its base, can serve as an axial abutment for the body of the electric pump 220. Still more particularly, the thickness of this finger 262 may be adapted such that its radially inner end is sandwiched between the lower wall of the electric pump 220 and the end portion 237 to prevent axial movement of the electric pump 220 on the annulus 252.

Furthermore, the finger 262 is itself preferably provided with a lug or tooth axially oriented inwardly of the annulus 252. This lug or tooth is adapted to enter into a corresponding concave sector formed at the base of the pump 220 to prevent rotational movement of the pump 220 in the annulus 252. The assembly comprising the annulus 252, the ribs 254, the arm 260, the finger 262 and its tooth are preferably integrally formed as one-piece of molded plastic construction, preferably of POM (polyoxymethylene).

According to the embodiment represented in FIGS. 1 to 13, the third assembly 300, providing the connection between the mount 100 and the pump assembly 200 comprises two tubular members 310, 320. More particularly, the tubular members 310, 320, according to the embodiment illustrated on FIGS. 1 to 13, are formed of bent metal tube. Thus tubes 310, 320 have a bend forming an angle of the order of 120° in the preferred embodiment. The two tubes 310, 320 preferably extend parallel to each other. At their upper end, they are respectively engaged in the pipe section 141 provided at the base of the lower shell 130, and in a similar parallel pipe section 141' (FIG. 5) also provided at the base of the lower shell 130. It will be noted that in the preferred embodiment of the present invention, one of the linking members 320 provided between the two assemblies 100, 200 also has the function of passing fuel, more particularly returned fuel coming from the pressure regulator 160. Preferably, the tubes 310 and 320 are held in the conduit sections 141, 141' by simple force fitting. The same tubes 310, 320 are similarly engaged and held by force or press-fit in the tubular portions 257 and 258 attached to the pump support annulus 252.

The tubular linking members 310, 320 are preferably provided along their length with reference beads 313, 323. These reference beads 313, 323 may be used to control the positioning of the linking members 310, 320. Typically, at least one of the reference beads 313, 323 may bear against one of the corresponding tubular receiving members 141, 141' or 257, 258.

Where appropriate, the annulus 252 for receiving the fuel pump 220 may be prevented from moving on at least one of the linking members 310, 320 by any appropriate mechanism. This is preferably a serrated lock washer or ring 330 as illustrated in particular in FIG. 1. In a manner known per se, such a lock washer bears on a tubular portion 257 or 258 at its outer periphery, and has teeth on its inner periphery adapted to elastically engage the periphery of the end of one of the linking members 310, 320. As can be seen in the accompanying drawings, after assembly in one preferred embodiment, the axis of the fuel pump 220 is parallel to the inclined lower portions of the linking members 310, 320.

Figure 17:
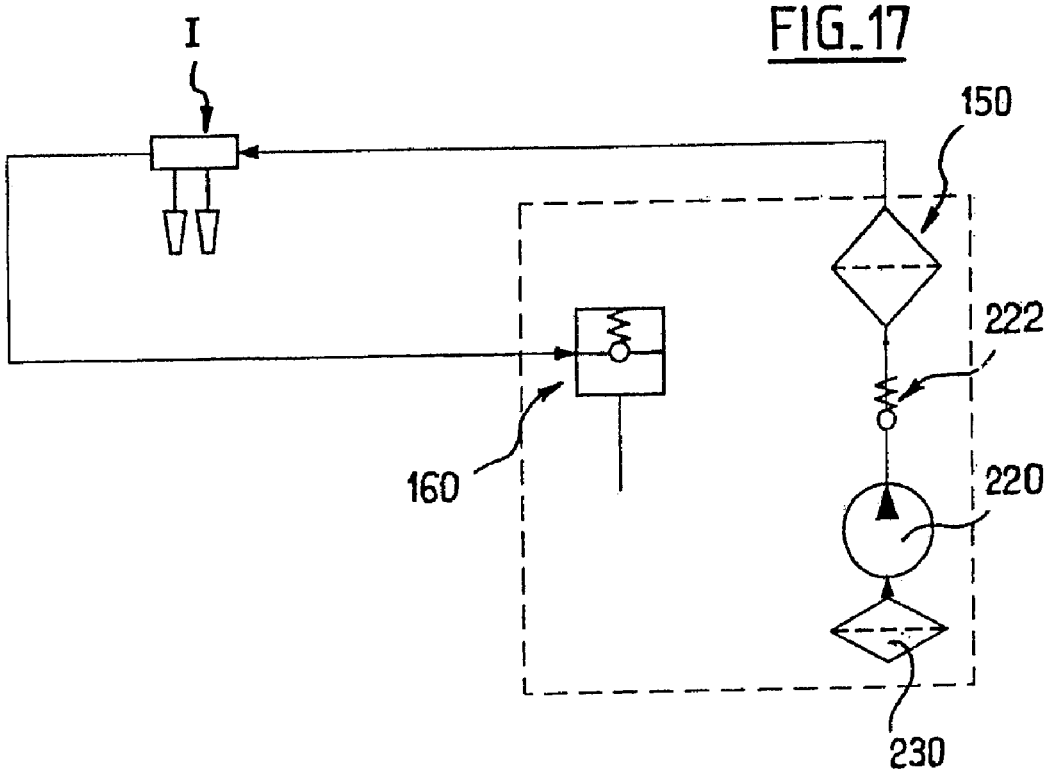
FIG. 17 is a diagrammatic representation of the fluid circuit of the fuel delivery assembly according to one presently preferred embodiment of the present invention.

The path of fuel flow is illustrated diagrammatically in FIG. 17. After passing through the inlet filter 230, fuel is drawn in by the fuel pump 220, discharged under pressure through the fuel pump outlet and check valve 222, and via the conduit 210 and the conduits 134, 135 reaches the inlet of the filter chamber 128. The fuel then passes radially inwardly towards the interior of the filter 150 through the pipes 129 and 180 and to the injector manifold referenced in FIG. 17. When the pressure of the fuel exceeds the threshold set by the regulator 160, the excess fuel is returned to the pipe 182. From there it reaches the inlet of the regulator 160 via pipes 127 and 132. It passes across the latter and comes out again by the barrel 137 of the conduit 141 and the linking member 320.

Naturally the present invention is not limited to the specific embodiment which has just been described but covers any variations or modifications in accordance with its spirit and scope as set forth by the appended claims.

Figure 15:
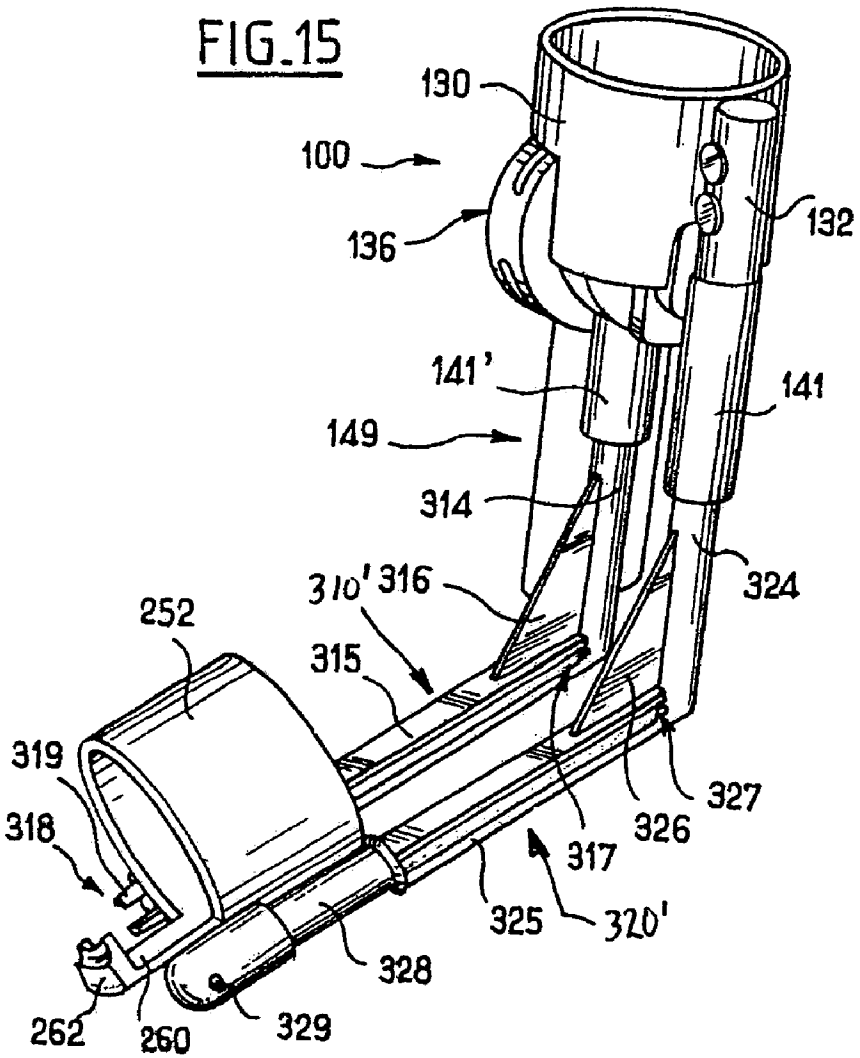
FIG. 15 is another perspective view of the third assembly of FIG. 14.
Figure 14:
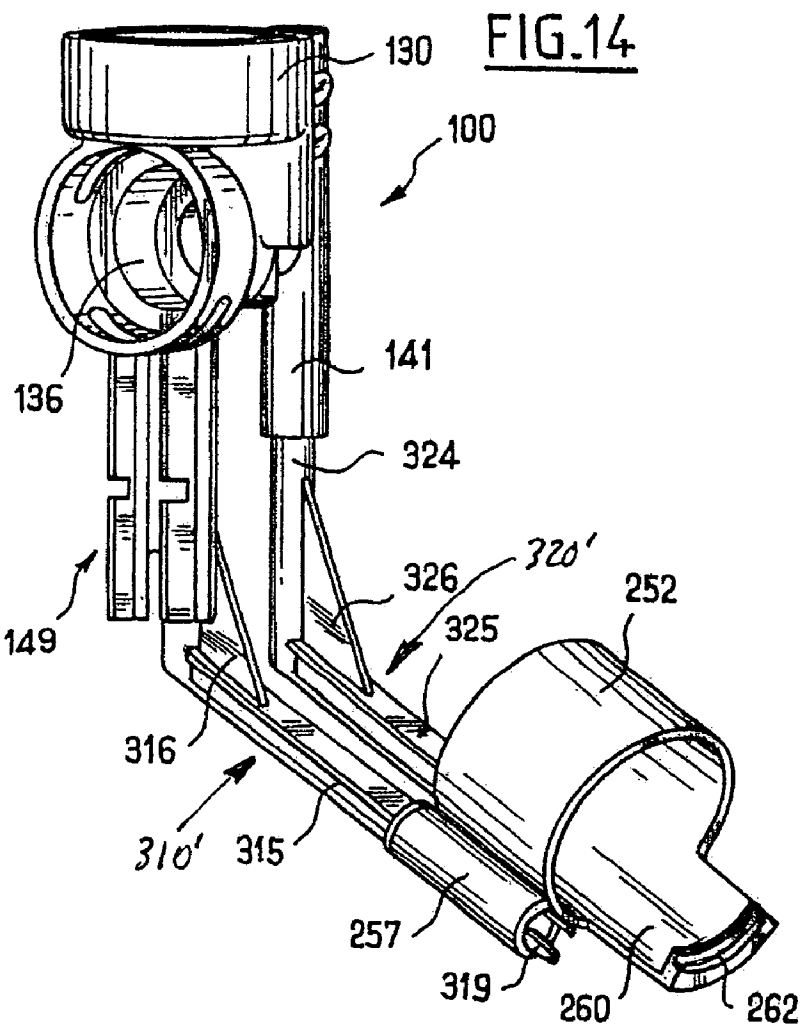
FIG. 14 is a perspective view of a third assembly of a second presently preferred embodiment of a fuel delivery assembly.

In particular, as shown in FIGS. 14 and 15, linking members 310, 320 may be the subject of a variety of embodiments, shapes and sizes. In FIGS. 14 and 15 linking members 310', 320' are preferably of molded plastic construction, desirably of POM (polyoxymethylene).

Still more particularly, the linking members 310', 320' represented in FIGS. 14 and 15 have a general form of a right angle each including in its upper portion, a respective hollow tube 314, 324 and extending in the lower portion to a straight member 315, 325. The linking members may be straight, or bent at any desired angle for a wide range of applications.

The tubes 314, 324 are adapted to be press-fit into the tubular sections 141, 141' of the lower shell 130 of the first assembly 100. Preferably, stiffening webs or braces 316, 326 connect the base of the tube 314, 324 and the adjacent end of the straight members 315, 325. The latter are preferably formed as a guide in the form of a gutter or rail to enable fuel from at least one to flow. To that end, the members 314, 324, have an orifice 317, 327 at their base opening into the aforementioned gutter formed on the member 315, 325.

Members 315, 325 are themselves provided at their end opposite the tubes 314, 324 with end portions 318, 328 adapted to cooperate with the tubular portions 257, 258 of the housing 252. These sections 318, 328 preferably comprise structures in the form of clips 319, 329, having the form of two elastic tongues, at their free end, adapted to fix members 315, 325, by clipping onto the tubular portions 257, 258.

What is claimed is:

1. A fuel delivery assembly for vehicles, comprising:

a first assembly defining a mount adapted to be fixed onto a wall of a fuel tank and which carries at least one accessory and has at least two pipe sections;

a second assembly including an electric motor fuel pump and at least two tubular portions; and a third assembly including at least two interchangeable linking members respectively fixed on the first assembly by an interference fit between the linking members and the pipe sections and on the second assembly by an interference fit between the linking members and the tubular portions, to provide support to the second assembly from the first assembly.

2. The fuel delivery assembly of claim 1, wherein at least one of the linking members is tubular and hollow to permit fuel flow therethrough.

3. The fuel delivery assembly of claim 1, wherein the accessory is a fuel filter.

4. The fuel delivery assembly of claim 1, wherein the accessory is a fuel pressure regulator.

5. The fuel delivery assembly of claim 1, wherein the accessory is a fuel level sensor.

6. The fuel delivery assembly of claim 1, wherein the first assembly includes two corresponding shells that define a filter chamber.

7. The fuel delivery assembly of claim 1, wherein the first assembly integrally defines at least one conduit through which fuel discharged from the fuel pump flows.

8. The fuel delivery assembly of claim 3, wherein the fuel filter is clamped to the first assembly.

9. The fuel delivery assembly of claim 1, wherein the first assembly is made from polyoxymethylene.

10. The fuel delivery assembly of claim 3, wherein the filter is an annular filter disposed in a chamber formed in the first assembly, said chamber having an outlet conduit which communicates with a center of the filter and an inlet conduit which communicates with the periphery of the filter.

11. The fuel delivery assembly of claim 1, wherein the first assembly defines a housing for receiving a pressure regulator.

12. The fuel delivery assembly of claim 11, wherein the first assembly defines two concentric conduits with one adapted to communicate with the inlet of the pressure regulator and the other adapted to communicate with the outlet of a pressure regulator.

13. The fuel delivery assembly of claim 1, wherein the first assembly defines two coaxial conduit sections separated by a wall and formed in one-piece with the mount.

14. The fuel delivery assembly of claim 1, which also includes an inlet filter provided with an inner brace and carried by the fuel pump.

15. The fuel delivery assembly of claim 14, wherein the inlet filter includes an end portion of plastic material adapted to be received on and to extend the inlet of the fuel pump.

16. The fuel delivery assembly of claim 15, wherein the end portion is integral with the filter and includes a conduit that has the general shape of an L.

17. The fuel delivery assembly of claim 15, wherein the inlet filter is attached to the fuel pump at a location spaced from the brace to facilitate bending of the fuel filter.

18. The fuel delivery assembly of claim 1, wherein the second assembly includes an annular housing adapted to receive the fuel pump.

19. The fuel delivery assembly of claim 18, wherein the annular housing adapted to receive the fuel pump includes longitudinal ribs on its internal surface to provide an interference fit with the fuel pump.

20. The fuel delivery assembly of claim 1, wherein the second assembly includes a housing provided with elongated tubular portions adapted to receive the associated ends of the linking members to connect the second assembly and third assembly.

21. The fuel delivery assembly of claim 1, wherein the second assembly includes a housing for receiving the fuel pump that further includes an arm having a portion defining a lower axial abutment for the fuel pump.

22. The fuel delivery assembly of claim 21, which also includes a fuel filter carried by the fuel pump and wherein the portion of the arm defining an axial abutment for the fuel pump is adapted to be sandwiched between the fuel pump and the filter in order to prevent axial movement of the fuel pump.

23. The fuel delivery assembly of claim 21, wherein the portion of the arm defining an axial abutment for the electric pump includes a tooth adapted to engage a corresponding sector of the electric pump to prevent it from rotating.

24. The fuel delivery assembly of claim 1, wherein the linking members are formed of metal tube.

25. The fuel delivery assembly of claim 1, wherein the linking members are formed of plastic.

26. The fuel delivery assembly of claim 1, wherein the linking members are bent.

27. The fuel delivery assembly of claim 1, wherein the linking members include reference beads that limit insertion of the linking members into one of the pipe sections or the tubular portions.

28. The fuel delivery assembly of claim 1, wherein the linking members have lower sections of gutter form adapted to guide fuel.

29. The fuel delivery assembly of claim 1, which also includes at least one lock washer attached to a linking member and the second assembly to prevent the linking member from moving with respect to the second assembly.

30. The fuel delivery assembly of claim 1, wherein the linking members include clips for attaching the linking members to the second assembly.

31. The fuel delivery assembly of claim 12, wherein one of the pipe sections includes an orifice communicating with the outlet of the fuel pressure regulator and fuel discharged from the outlet of the fuel pressure regulator flows into the pipe section and the corresponding linking member.

32. A fuel delivery assembly, including:

a first assembly including a flange adapted to be fixed onto a wall of a fuel tank, a cup carried by the flange and defining at least part of a chamber, and a housing formed in one-piece with the cup and having at least one passage;

a second assembly including an electric motor fuel pump;

a third assembly including at least two linking members respectively fixed on the first assembly and on the second assembly to provide support to the second assembly from the first assembly;

a filter disposed in the chamber in communication with the fuel pump to filter fuel discharged from the fuel pump; and a fuel pressure regulator carried by the housing in communication with the at least one passage.

33. The fuel delivery assembly of claim 32, wherein the cup includes at least one pipe section and at least one of the linking members is disposed in the pipe section to connect the cup and linking member together.

34. The fuel delivery assembly of claim 33, wherein the at least one pipe section includes an orifice communicating with a passage in the housing so that fuel that flows through the passage enters the orifice and flows through the pipe section.

* * * * *